US005198835A

United States Patent [19]

Ando et al.

[11] Patent Number: 5,198,835

[45] Date of Patent: Mar. 30, 1993

[54] METHOD OF REGENERATING AN INK IMAGE RECORDING MEDIUM

[75] Inventors: Shigehito Ando; Eiichi Akutsu; Hiroo Soga; Kenji Ogi; Kazuo Maruyama, all of Kanagawa, Japan

[73] Assignee: Fuji Xerox Co., Ltd., Tokyo, Japan

[21] Appl. No.: 668,055

[22] Filed: Mar. 12, 1991

[30] Foreign Application Priority Data

Mar. 13, 1990 [JP] Japan ..... 2-59851

[51] Int. Cl.[5] ..... B41J 2/525

[52] U.S. Cl. ..... 346/76 PH; 400/197; 400/202; 400/202.2

[58] Field of Search ..... 400/120; 197, 198, 199, 400/200, 201, 202, 202.1, 202.2, 202.3, 202.4; 346/76 PH, 1.1

[56] References Cited

U.S. PATENT DOCUMENTS

| | | | |
|---|---|---|---|
| 4,128,348 | 12/1978 | Steele et al. | 400/198 |
| 4,268,368 | 5/1981 | Aviram et al. | 400/197 |
| 4,359,748 | 11/1982 | Pasini et al. | 400/198 |
| 4,598,302 | 7/1986 | Swidler et al. | 400/198 |
| 4,882,593 | 11/1989 | Tomma et al. | 400/202.4 |
| 4,967,206 | 10/1990 | Akutsu et al. | 366/135.1 |

FOREIGN PATENT DOCUMENTS

| | | | |
|---|---|---|---|
| 0124672 | 9/1980 | Japan | 400/202.4 |
| 0155984 | 9/1983 | Japan | 400/198 |
| 0259485 | 12/1985 | Japan | 400/198 |
| 0078680 | 4/1986 | Japan | 400/197 |
| 1-60622 | 3/1990 | Japan . | |

*Primary Examiner*—Benjamin R. Fuller
*Assistant Examiner*—Huan Tran
*Attorney, Agent, or Firm*—Finnegan, Henderson, Farabow, Garrett & Dunner

[57] ABSTRACT

In a method of regenerating an ink image recording medium of a multilayered structure, after an ink image on the ink image recording medium is recorded, the surface of the heat-fusible ink layer of the ink image recording medium is uniformly charged. Then, a liquid ink for generating the ink layer, being placed under an electric field applied thereto, is supplied to the ink image recording medium. The liquid ink is prepared by dispersing heat-fusible ink powder into a liquid dispersion medium. As a result, the heat-fusible ink powder selectively sticks onto the portion on the ink release layer where the heat-fusible ink layer is absent because the ink was transferred. Finally, the ink image recording medium thus processsed is dried to remove the liquid dispersing medium.

24 Claims, 2 Drawing Sheets

METHOD OF REGENERATING AN INK IMAGE RECORDING MEDIUM

BACKGROUND OF THE INVENTION

1. Field of the Invention

The present invention relates to a method of regenerating an ink image recording medium, which is applied for an ink image recording system for recording ink images onto a transfer sheet by the thermal energy to which electric signals are converted.

2. Description of the Related Art

There is an ink image recording system of the current feed thermal transfer type in which an ink image is recorded by using an ink image recording medium having a multilayered structure consisting of an anisotropic conductive layer, a heating resistive layer for generating heat by an electric signal corresponding to an image signal, a conductive layer, and a heat-fusible ink surface-layer. After the ink image is transferred to the transfer sheet, the ink of the heat-fusible ink surface-layer of the ink image recording medium is partially lost because of the image transfer. In the image recording system, however, the ink image recording medium with the ink-lost ink layer is regenerated by supplying new ink to the ink-lost ink layer, and the regenerated ink image recording medium is used again.

FIG. 4 is a schematic view showing the ink image recording system. As shown in FIG. 4, an ink image recording medium 10 is transferred in the direction of an arrow B by transfer rolls 41. In a printer section 20, to print an ink image, the heat-fusing ink of the recording medium 10 is transferred onto an image-transferred sheet 23 lying on a back pressure roll 22, according to an electric signal from a recording head 21. The signal current flows to a ground point, by way of a return contact roll 26. Then, the ink recording medium 10 reaches an ink supply unit 30 where the recording medium is supplied with powder ink. Thereafter, the resultant recording medium is transferred to an ink layer smoothing unit 40. In the unit 40, the surface of the heat-fusible ink surface-layer is smoothed to complete the regeneration of the image recording medium. The regenerated recording medium is then used in the next image recording operation.

In the ink image recording system as stated above, when the ink image recording medium is regenerated, the heat-fusible ink powder sticks not only to the transferred portions, that is, the portions of the heat-fusible ink surface-layer where the ink has been transferred, but also to the non-transferred portions, that is, the portions where the ink is left. Accordingly, the ink layer of the regenerated ink image recording medium loses much of its thick uniformity. Because of the nonuniformity, the regenerated recording medium cannot be used repeatedly for a long time.

To solve the problem, there is a proposal in which the heat-fusible ink surface-layer is charged to the same polarity as that of the voltage of the charged ink particles, thereby to allow the powder ink to stick to only the transferred portions of the heat-fusible ink surface-layer. However, the proposal is still unsatisfactory in that a relatively high voltage is required, and that it is difficult to form a thin and uniform ink layer.

SUMMARY OF THE INVENTION

The present invention has been made to solve the above problem involved in the regeneration of the ink image recording medium, and has an object to provide a method of regenerating an ink image recording medium which can regenerate the ink image recording medium by prohibiting the ink particles from sticking onto the non-transferred portions of the heat-fusible ink surface-layer of the ink image recording medium.

The present invention includes a method of regenerating an ink image recording medium of a multilayered structure including an anisotropic conductive layer, a heating resistive layer for generating heat by an electric signal applied thereto, a conductive layer, an ink release layer, and a heat-fusible ink surface-layer, the method comprising the steps of: charging uniformly the surface of the heat-fusible ink surface-layer of the ink image recording medium after a recording operation for an ink image is completed using the ink image recording medium; supplying a liquid ink for regenerating the heat-fusible ink surface-layer to the ink image recording medium the liquid ink being prepared by dispersing heat-fusible ink powder into a liquid dispersion medium, whereby the heat-fusible ink powder selectively sticks onto the portions on the ink release layer where the heat-fusible ink surface-layer is absent; and drying the ink image recording medium thus processed, whereby to remove the liquid dispersion medium.

An ink image recording system according to the present invention comprises: an ink image recording medium, shaped like an endless belt, including an anisotropic conductive layer, a heating resistive layer, a conductive layer, an ink release layer, and a heat-fusible ink surface-layer; transfer rolls for circulatingly transferring the ink image recording medium; an ink image recording section for transferring an ink image on the ink image recording medium onto a transfer sheet according to an electric signal; charging means for uniformly charging the ink image recording medium emanating from the recording section; an ink supply unit, disposed downstream of the charging means, including a container for containing a liquid ink for regenerating the heat-fusible ink surface-layer of the ink image recording medium, an electrode soaked in the liquid ink and applied with a bias voltage, and a roll, disposed opposite to the electrode, for transferring the ink image recording medium in contact with the liquid ink through a gap between the electrode and the roll; and an ink layer smoothing unit for smoothing the ink layer of the ink image recording medium supplied from the ink supply unit.

DETAILED DESCRIPTION OF THE PREFERRED EMBODIMENT

Figure 1:
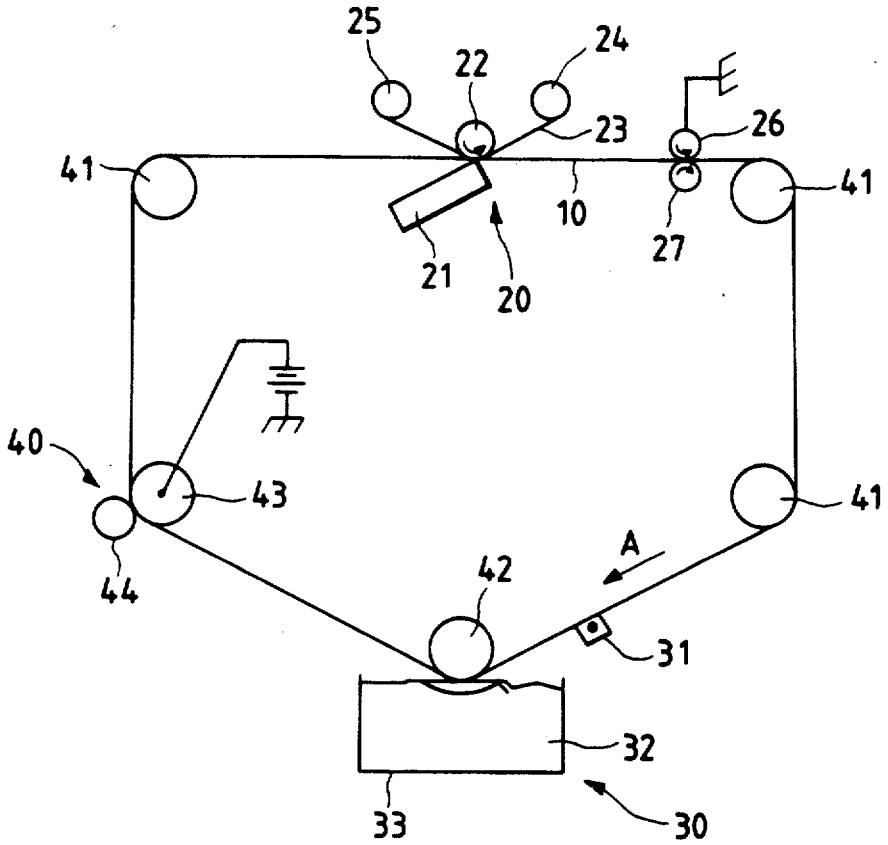
FIG. 1 is a schematic view showing an ink image recording system in which a method of regenerating an ink image recording medium according to the present invention is executed.
Figure 2:
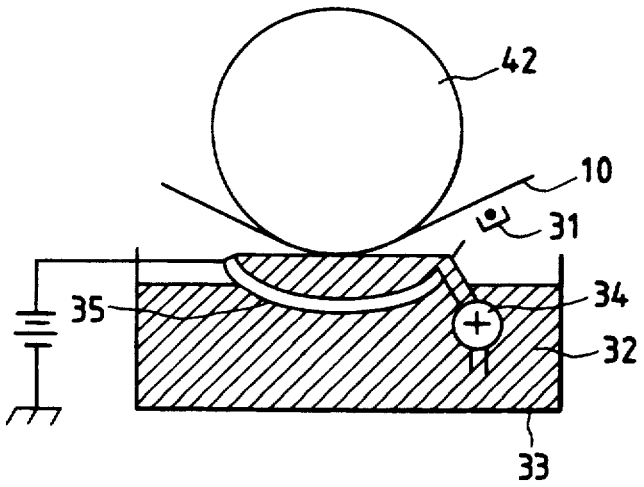
FIG. 2 is a schematic view showing an ink supply unit used in the image recording system of FIG. 1.

A method of regenerating an ink image recording medium according to an embodiment of the present invention will be described with reference to the accompanying drawings. FIG. 1 is a schematic view showing an ink image recording system in which the recording medium regenerating method of the invention is executed. FIG. 2 is a schematic view showing an ink supply unit in the image recording system shown in FIG. 1.

Figure 3:
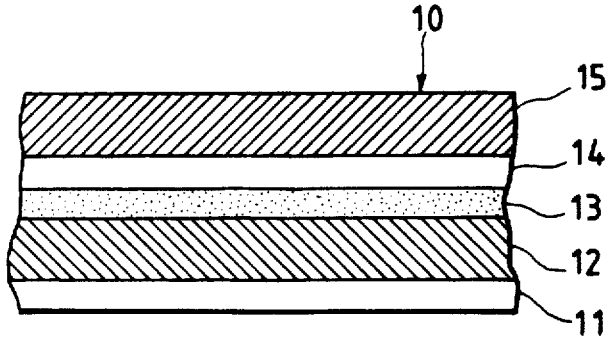
FIG. 3 is a partial cross sectional view showing an ink image recording medium to be regenerated by the regenerating method of the invention.
Figure 4:
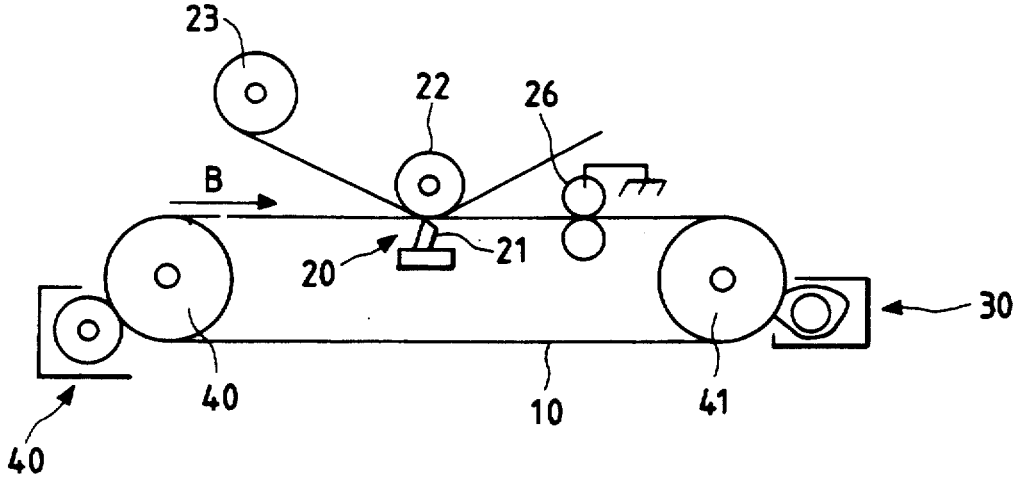
FIG. 4 is a schematic view showing a conventional ink image recording system.

An ink image recording medium, designated by reference numeral 10 in FIG. 1, will first be described in detail. The ink image recording medium 10 has a multilayer structure, as shown in FIG. 3, including an anisotropic conductive layer 11, a heating resistive layer 12, a conductive layer 13, an ink release layer 14, and a heat-fusible ink layer 15.

The anisotropic conductive layer 11 functions to reduce the power loss caused by a resistance of the recording medium 10 when a current flows through the recording medium 10 in the thickness direction of the recording medium 10. The anisotropic conductive layer 11 helps, reduce Joule heat generated by the contact resistance on the recording medium, 10 when it contacts a needle electrode and the damage to the recording medium from the Joule heat. The anisotropic conductive layer 11 may be an isolated conductive pattern layer in the form of a minute electrode or a layer made of insulating material such as ceramics or synthetic resin, in which a conductive path made of conductive material such as metal powder or conductive ceramic particles is formed.

When the isolated conductive pattern layer is used for the anisotropic conductive layer 11 of the ink image recording medium 10, the heating resistive layer 12 is used as a support layer. When the isolated conductive pattern layer is not used for the anisotropic conductive layer 11, the anisotropic conductive layer 11 per se is used as the support layer, and a heating resistive layer in the form of a thin film is formed over one of the surfaces of the anisotropic conductive layer 11.

The heating resistive layer 12 receives the current fed from the anisotropic conductive layer 11 and converts it into Joule heat. The Joule heat converted fuses ink and transfers it on a transfer means, such as a transfer sheet. A conductive layer made of heat resistive resin in which conductive material such as carbon or metal powder is dispersed, may be used for the heating resistive layer 12. The heat resistive resin may be any of polyimide resin, polyimide amide resin, silicon resin, fluoric resin, epoxy resin and the like. Another example of the heating resistive layer 12 is a thin film made of high resistance material such as $ZrO_2$, $Al_2O_3$ or $SiP_2$, and conductive material such as Ti. Al, Ta, Cu, Au or Zr. The volume specific resistance of the heating resistive layer 12 is preferably within the range between $10^{-2}$ and $10^2$ Ω.cm. The thickness of the layer 12 is preferably within the range between 1000 Å and 500 μm. The heating resistive layer specified by those figures is excellent in film depositing stability and film stickiness.

The conductive layer 13 serves as an electrode to diffuse the current flowing into the heating resistive layer 12 and to return it, and also serves as one of the opposite electrodes in the corona charging operation. The conductive layer 13 is formed by vapor deposition, sputtering or any of other suitable thin film forming techniques so as to have the surface resistance of 50 Ω per square or less preferably. The thickness of the conductive layer is preferably within the range between 500 Å and 5 μm. Particularly, it is preferable to set the thickness within the range between 1000 Å and 2000 Å for the heat leakage and the required conductive characteristic.

The ink release layer 14 is provided for enabling ink to be transferred onto the transfer sheet even with low print energy. Accordingly, the critical surface tension of the ink release layer 14 is adjusted so as to gain such easy transfer of the ink. In other words, this layer is a thin film with low surface energy function. Basically, the critical surface tension of the ink release layer 14 is lower than the surface energy of the transfer sheet, and is preferably 38 dyne/cm or less. Further, the decomposing point or melting point is preferably 180° C. or more.

In the invention, the thickness of the ink release layer 14 is preferably within the range between 0.08 μm and 3 μm, and the volume specific resistance is preferably $10^8$ Ω·cm or more. When the ink release layer 14 so specified is used, the transferred portion or the exposed portion of the ink release layer receives only a small charge from the corona charging operation, while the non-transferred portion of the heat-fusible ink surface-layer can effectively be charged.

The material of the ink release layer 14 may be any of a thermosetting silicon resin, fluoric resin, and the like.

The heat-fusible ink surface-layer 15 layered over the ink release layer is prepared by dispersing known dye or pigment, such as carbon plastic, in thermoplastic resin having the melting point of 140° C. or less. The thickness of the heat-fusible ink surface-layer 15 is preferably within the range between 0.5 μm and 15 μm.

The ink used for regenerating the heat-fusible ink layer 15 is prepared by dispersing heat-fusible ink powder into liquid dispersion medium. The liquid developer generally used for the electrophotography may be used for the ink. The heat-fusible ink powder has preferably the same components as those of the heat-fusible ink surface-layer. The dispersion medium is preferably a liquid dispersion medium which has a volume specific resistance of $10^5$ Ω·cm or more and a boiling point of 110° C. or more.

Referring again to FIG. 1, in an ink image recording section 20 of the ink image recording system, an ink image recording head 21 is arranged so that the head 21 is slidably moved on the surface of the anisotropic conductive layer 11 of the ink image recording medium 10. A transfer sheet 23 is supplied from a transfer sheet roll 25, and pressed against the heat-fusible ink surface-layer 15, and then taken up by a transfer sheet take-up roll 24. A return-path contact roll 26 and a back-up roll 27 are disposed so as to come into contact with the conductive layer 13 exposed at the side edges of the recording medium. Reference numerals 41 designate transfer rolls for transferring the ink image recording medium 10 in the direction of an arrow A, and numeral 30 designates an ink supply unit. In the ink supply unit 30, a charging unit 31, such as a corona discharging unit, is located close to a developing dish 33 containing liquid ink (hereafter, referred to as a developer) for regenerating the ink layer. A developing electrode 35 is disposed opposite to a back roll 42, and the developer is circulated through a gap between the back roll 42 and the developing electrode 35 by developer circulating unit 34, as shown in FIG. 2. An ink layer smoothing unit 40 includes a heat smoothing electrode roll 43 and a back pressure roll 44.

In the ink image recording system thus arranged, the ink image recording medium 10 is transferred to an ink image recording section 20 with the aid of the transfer rolls 41. In the recording section 20, the heat-fusible ink surface-layer 15 of the recording medium 10 is transferred onto the transfer sheet 23 according to the signal current from the ink image recording head 21, so that the ink image is recorded in the transfer sheet 23. After the ink image is recorded, the ink image recording medium 10 is transferred toward the ink supply unit 30. Before the medium 10 reaches the ink supply unit 30, the medium 10 is uniformly charged by the corona charging unit 31. The charging voltage is generally chosen to be within the range between 10 V and 200 V. Then, the ink image recording medium 10 is further transferred in contact with the developer 32 on the back roll 42. The heat-fusible ink powder in the developer is charged, since the developing electrode 35 applied with a bias voltage is provided opposite to the back roll 42. The bias voltage applied to the developing electrode 35 has the same polarity as that of the charge voltage of the heat-fusible ink surface-layer 15, and is usually set to be a low voltage, approximately 70 V. The developer circulates through the gap between the ink image recording medium 10 and the developing electrode 35. With the developer circulation, the heat-fusible ink powder selectively sticks onto the portions of the surface of the ink release layer 14 of the recording medium 10 where the heat-fusible ink surface-layer 15 is now absent, that is, the transferred portions on the heat-fusible ink surface-layer 15.

The ink image recording medium 10 is transferred to the ink layer smoothing unit 40. In the unit, the recording medium 10 travels between the heat smoothing electrode roll 43 and the back pressure roll 44, so that the solvent is removed out of the recording medium 10, to regenerate the heat-fusible ink surface-layer 15.

As described above, after completion of recording the ink image, the heat-fusible ink surface-layer 15 of the ink image recording medium 10 is charged by the corona charging unit 31. In the charging operation, the conductive layer 13 of the ink image recording medium 10 serves as one of the opposite electrodes and is kept at ground potential. Under this condition, the corona charging unit 31 provides only a small charge to the transferred portions of the heat-fusible ink layer 15, but uniformly charges the other portions thereof where the ink layer is left, because of the presence of the uniform conductive layer 13 in the ink image recording medium 10. The heat-fusible ink powder in the liquid ink for regenerating the heat-fusible ink surface-layer 15 have been charged with the same polarity as that of the heat-fusible ink layer 15, by the developing electrode 35. Therefore, the ink powder repels the charges of the ink layer not transferred, so that the ink powder will not stick to that ink layer. On the other hand, in the recording medium 10, the thin-film ink release layer 14 is layered over the conductive layer 13 on the transferred portions of the ink layer 15. Therefore, the heat-fusible ink powder is electrostatically attracted to the transferred portions on the ink release layer 14, and deposited thereover.

Without limiting this invention, the following example is given to illustrate the preferred mode of operation.

EXAMPLE

At first, a titanium (Ti) layer having the thickness of 5000 Å was formed on one of the surfaces of a conductive polyimide film having the surface resistance of 550 Ω per square and the thickness of 30 μm, by the high-frequency sputtering method. Photoresist was applied on the Ti layer and dried for 8 minutes at 90° C., thereby to form a resist film having thickness of 1.6 μm. The photo resist film was exposed to light through a mask having square patterns of 18 μm × 18 μm arrayed over the entire surface at pitches of 25 μm, and was developed. Then, the photo resist film was placed in an oven, and was heated for 15 minutes at 110° C. in $N_2$ atmosphere within the oven, to harden the resist film. The resultant structure was subjected to the reactive ion etching process, to remove the portions of the Ti layer where the resist film is absent. Thereafter, the resultant was put in an acetone bath where it was radiated with the ultrasonic wave to remove the resist film. In this way, an anisotropic conductive layer having a conductive pattern was formed.

Aluminum (Al) was sputtered on the other surface of the conductive polyimide film by a high-frequency sputtering method, thereby to form a conductive layer whose thickness is 1000 Å.

The entire surface of the formed conductive layer except a portion to serve as a return-path electrode contact was coated with thermosetting silicon resin and the resultant structure was heated for one hour at 150° C. to harden the thermosetting silicon resin, thereby to form an ink release layer whose critical surface tension is 32 dyne/cm and thickness is 0.3 μm.

The film-like structure thus formed was curved and both ends thereof were connected to each other, to form an endless belt whose inner side is the anisotropic conductive layer. The endless belt was used as an ink carrier for image recording.

A colored heat-fusible ink surface-layer whose thickness is 1.1 μm, containing thermoplastic resin having the melting point of 80° C. as a main component, was layered on the ink release layer. Here, an ink image recording medium was formed.

The ink image recording medium thus formed was set in the ink image recording system as shown in FIG. 1, and tested in the following way.

The ink image recording head 21 consisted of eight circular, protruded conductive portions having the height of 10 μm and the width of 210 mm, which were arrayed per 1 mm (at 125 μm pitches and 75 μmϕ). The recording head 21 was pressed against the ink recording medium at pressure of 600 g/cm, and was transferred at speed of 50 mm/sec. A pulse signal whose pulse period is 2.5 ms/dot and duty ratio is 40%, was applied to the recording head.

In the ink supply unit 30, the gap between the developing electrode surface and the ink image recording medium was set to 1 mm, and a bias voltage of 80 V was applied to the developing electrode. The ink image recording medium was uniformly charged by the charging unit, so that a bias voltage of 30 V appears on the heat-fusible ink surface-layer.

A developer used was prepared by dispersing colored acrylic polymer as the heat-fusible ink powder into isoparaffin petroleum solvent, which is used in general copying machines. Here, the volume specific resistance of the solvent is $10^{10}$ Ω.cm or more, and the boiling point thereof is 150° C. or more. The developer thus prepared was put in the developing dish 33, and was circulated through the gap between tho developing electrode 35 and the ink image recording medium 10 by the developer circulating unit 34.

The ink image recording system was operated under the above conditions, and it was confirmed that the heat-fusible ink powder was supplied to the ink transferred portion.

Then, the surface of the ink layer thus regenerated was smoothed by the heat smoothing electrode roll. The SUS304 having the diameter of 45 mmϕ was used for the heat smoothing electrode roll. The back pressure roll was an aluminum roll having the thickness of 4 mm and the diameter of 45 mmϕ, covered with a film whose thickness is 25 μm made of tetrafluoro-ethylene whose critical surface tension is 18 dyne/cm. The heat smoothing electrode roll and the back pressure roll were oppositely disposed. The ink image recording medium having the heat-fusible ink powder thereon was passed between the heat smoothing electrode roll and the back pressure roll, in a manner that the anisotropic conductive layer was in contact with the heat smoothing electrode roll. In this case, a pressure of 1.5 kg/cm was applied to the ink image recording medium by the back pressure roll. Further, a voltage of 6 V was applied between the heat smoothing electrode roll and the conductive layer of the ink image recording medium, to cause current to flow therethrough. With the current flow, the heating resistive layer of the ink image recording medium generated heat. Then, the solvent was evaporated by the heat thus generated, the ink powder was softened, and hence the heat-fusible ink surface-layer was smoothed.

The ink image recording operation and the ink layer regenerating operation were repeated 100 times. It was confirmed that images with good image quality were consecutively formed.

COMPARISON

As a vehicle for comparison, the ink image recording and heat-fusible ink surface-layer regenerating operations likewise were performed using the same ink image recording medium as in the above example. The corona discharge following the ink image recording operation was not performed.

From the results obtained by repeating the ink image recording and heat-fusible ink surface-layer regenerating operations, it was confirmed that the heat-fusible ink surface-layer was thick, and the difference between the transferred portions and the non-transferred portions was increased in thickness of the ink layer.

As seen from the foregoing description, in the present invention, after the ink image is recorded, the heat-fusible ink surface-layer is charged through the corona discharging operation. The ink image recording medium is passed through the liquid ink for regenerating the ink layer being applied with the voltage. The heat-fusible ink surface-layer is regenerated during the passage of the recording medium through the liquid ink. Therefore, under the extremely low voltage applied, the heat-fusible ink powder selectively sticks onto the portions of the ink release layer where the heat-fusible ink surface-layer was transferred and now is absent, but is prohibited from sticking onto the portions where the ink layer is left since it was not transferred.

Accordingly, the difference in ink layer thickness between the transferred portions and the non-transferred portions is reduced. Even if the ink image recording medium is repeatedly used for a long time, the medium can provide high quality ink images.

While the present invention has specifically been described, it should be understood that the invention may variously be changed, modified, and altered within the scope of the appended claims.

What is claimed is:

1. A method of regenerating an ink image recording medium of a multilayered structure including an anisotropic conductive layer, a heating resistive layer for generating heat by an electric signal applied thereto, a conductive layer, an ink release layer, and a heat-fusible ink surface-layer, said method comprising the steps of:

uniformly surface-charging the heat-fusible ink surface-layer of the ink image recording medium after a recording operation for an ink image is completed using the ink image recording medium;

supplying a liquid ink for regenerating the heat-fusible ink surface-layer to the ink image recording medium with an electric field applied to said liquid ink, said liquid ink being prepared by dispersing heat-fusible ink powder into a liquid dispersion medium, whereby said heat-fusible ink powder selectively sticks onto the ink release layer only where the heat-fusible ink surface-layer is absent; and drying the ink image recording medium thus processed, whereby to remove said liquid dispersion medium.

2. The method according to claim 1, wherein said electric field is generated by applying a voltage to an electrode soaking in said liquid ink.

3. The method according to clam 2, wherein said voltage for generating the electric field is a low voltage maintained at a same polarity as the heat-fusible ink surface-layer voltage.

4. The method according to claim 3, wherein said voltage for generating the electric field is approximately 70 V.

5. The method according to claim 1, wherein said heat-fusible ink surface-layer is charged by a corona charging unit.

6. The method according to claim 5, wherein said corona charging unit charges the surface of the heat-fusible ink surface-layer at a voltage within the range between 10 V and 200 V.

7. The method according to claim 1, wherein said heating resistive layer has a volume specific resistance within a range between $10^{-2}$ Ω·cm and $10^{2}$ Ω·cm and a thickness within a range between 1000 Å and 500 μm.

8. The method according to claim 1, wherein said conductive layer of the ink image recording medium is 50 Ω per square or less in surface resistance.

9. The method according to claim 8, wherein said conductive layer of the ink image recording medium has a thickness within a range between 500 Å and 5 μm.

10. The method according to claim 1, wherein aid ink release layer of the ink image recording medium is specified in that a thickness is within a range between 0.08 and 33 μm, a volume specific resistance is $10^{8}$ Ω·cm or more, a critical surface tension is 38 dyne/cm or less, and a melting point is 180° C. or more.

11. An ink image recording system comprising:

an ink image recording medium, shaped like an endless belt, including an anisotropic conductive layer, a heating resistive layer, a conductive layer, an ink release layer, and a heat-fusible ink surface-layer;

transfer rolls for circulatingly transferring the ink image recording medium;

an ink image recording section for transferring an ink image on the ink image recording medium onto a transfer sheet according to an electric signal;

charging means for uniformly charging the ink image recording medium emanating from the recording section;

an ink supply unit, disposed downstream of the charging means, including a container for containing a liquid ink for regenerating the heat-fusible ink surface-layer of the ink image recording medium, an electrode soaked in said liquid ink and applied with a bias voltage, and a roll, disposed opposite to the electrode, for transferring the ink image recording medium in contact with said liquid ink through a gap between the electrode and the roll; and an ink layer smoothing unit for smoothing the ink layer of the ink image recording medium supplied from said ink supply unit.

12. The ink image recording system according to claim 11, wherein said ink image recording section includes a recording head for applying to the ink image recording medium an electric current according to said electric signal, and a roll for pressing the transfer sheet against the heat-fusible ink surface-layer of the ink image recording medium.

13. The ink image recording system according to claim 12, further comprising a current return contact roll connected to a ground for providing a return path for the signal current supplied from the recording head.

14. The ink image recording system according to claim 11, wherein said charging means is a corona charging unit.

15. The ink image recording system according to claim 14, wherein said corona charging unit charges the ink image recording medium at a voltage within a range between 10 V and 200 V.

16. The ink image recording system according to claim 11, wherein said bias voltage applied to the electrode in the ink supply unit is a low voltage maintained at a same polarity as the heat-fusible ink surface-layer voltage.

17. The ink image recording system according to claim 16, wherein said bias voltage applied to the electrode is approximately 70 V.

18. The ink image recording system according to claim 11, wherein aid ink supply unit further includes ink circulating means for circulating the liquid ink through a gap between the electrode and the roll.

19. The ink image recording system according to claim 11, wherein said liquid ink is a heat-fusible ink powder dispersed into a liquid dispersion medium.

20. The ink image recording system according to claim 11, wherein said ink layer smoothing unit includes a heat smoothing roll and a back pressure roll, said rolls nipping and transferring the ink image recording medium.

21. The ink image recording system according to claim 11, wherein said heating resistive layer has a volume specific resistance within a range between $10^{-2}$ Ω·cm and $10^{2}$ Ω·cm and a thickness within a range between 1000 Å and 500 μm.

22. The ink image recording system according to claim 11, wherein said conductive layer of the ink image recording medium is 50 Ω per square or less in surface resistance.

23. The ink image recording system according to claim 22, wherein said conductive layer of the ink image recording medium has a thickness within a range between 500 Å and 5 μm.

24. The ink image recording system according to claim 11, wherein said ink release layer of the ink image recording medium is specified in that a thickness is within a range between 0.08 μm and 33 μm, a volume specific resistance is $10^{8}$ Ω·cm or more, a critical surface tension is 38 dyne/cm or less, and a melting point is 180° C. or more.

* * * * *

UNITED STATES PATENT AND TRADEMARK OFFICE

CERTIFICATE OF CORRECTION

PATENT NO. : 5,198,835

DATED : March 30, 1993

INVENTOR(S) : Shigehito Ando et al.

It is certified that error appears in the above-indentified patent and that said Letters Patent is hereby corrected as shown below:

Claim 10, column 8, line 52, change "aid" to --said--.

Claim 18, column 10, line 7, change "aid" to --said--.

In the Abstract, line 11, change "portion" to --portions--.

Signed and Sealed this

First Day of March, 1994

Bruce Lehman

BRUCE LEHMAN

*Commissioner of Patents and Trademarks*

*Attes::*

*Attesting Officer*